US005584721A

United States Patent [19]

Taniuchi et al.

[11] Patent Number: 5,584,721

[45] Date of Patent: Dec. 17, 1996

[54] CONNECTOR

[75] Inventors: Osamu Taniuchi; Youichi Nankoh; Hiroyuki Nakata; Makoto Fukamachi, all of Mie-ken, Japan

[73] Assignee: Sumitomo Wiring Systems, Ltd., Mie-ken, Japan

[21] Appl. No.: 647,824

[22] Filed: May 15, 1996

Related U.S. Application Data

[63] Continuation of Ser. No. 386,335, Feb. 10, 1995, abandoned, which is a continuation of Ser. No. 179,223, Jan. 7, 1994, abandoned.

[30] Foreign Application Priority Data

Jan. 13, 1993 [JP] Japan ..... 5-003777

[51] Int. Cl.[6] ..... H01R 13/629

[52] U.S. Cl. ..... 439/374; 439/377; 439/680

[58] Field of Search ..... 439/680, 681, 439/374, 377

[56] References Cited

U.S. PATENT DOCUMENTS

| | | | |
|---|---|---|---|
| 3,137,535 | 6/1964 | Collier et al. | 439/374 |
| 3,408,612 | 10/1968 | Bute et al. | 439/680 |
| 4,376,565 | 3/1983 | Bird et al. | 439/681 |
| 4,960,387 | 10/1990 | Davis et al. | 439/374 |
| 5,137,467 | 8/1992 | Arai | 439/374 |
| 5,460,548 | 10/1995 | Roth | 439/680 |

FOREIGN PATENT DOCUMENTS

| | | |
|---|---|---|
| 3826332 | 8/1989 | Germany . |
| 4-62772 | 2/1992 | Japan . |

OTHER PUBLICATIONS

Patent Abstracts of Japan, vol. 14, No. 194 (E–0919), Apr. 20, 1990.

Patent Abstracts of Japan, vol. 16, No. 267 (E–1217), Jun. 16, 1992.

*Primary Examiner*—Gary F. Paumen

*Attorney, Agent, or Firm*—Sughrue, Mion, Zinn, Macpeak & Seas

[57] ABSTRACT

This invention prevents a wrong contact of terminals when one of a pair of connector housings is inserted into the other housing in a slanted position. In the connector of this invention, a female connector housing 12 is provided on opposite ends with guide ribs 21 which extend in an insertion direction and serve as guide elements when the female connector housing 12 advances into a hood 13. The female connector housing 12 is provided with a wedge like resistance-applying projection 24 which extends vertically while a male connector housing 11 is provided on an interior of the hood 13 with a groove in which the projection 24 advances. Upon insertion of the female connector housing 12, the projection 24 press-contacts with a slot 25 so as to generate an insertion resistance, thereby correcting an imbalance of the insertion resistance of the terminals 14.

2 Claims, 5 Drawing Sheets

CONNECTOR

This is a Continuation of application Ser. No. 08/386,335 filed Feb. 10, 1995, which is a Continuation of application Ser. No. 08/179,223 filed Jan. 7, 1994, now abandoned.

BACKGROUND OF THE INVENTION

1. Field of the Invention

This invention relates to a connector which is coupled by means such as a lever and the like.

2. Statement of the Prior Art

A known connector has a lever type or bolt type coupling means. The connector has an advantage in that it can be coupled and detached by a small force and can be applied to a multipole (more than twenty) connector. For example, a basic construction of a lever type connector is known in Japanese Patent Public Disclosure No. 4-62772 (1992).

For convenience of explanation, a prior lever type connector will be explained below by referring to FIGS. 5 and 6.

FIGS. 5A to 5D are schematic side elevational views of a prior lever type connector, illustrating a principle of the connector. FIGS. 6A to 6C are schematic longitudinal cross sectional views of the prior lever type connector, illustrating a problem in the prior connector.

As shown in FIG. 5A, the prior lever type connector comprises a female connector housing 1 in which a number of female terminals are mounted and a male connector housing 2 in which a number of male terminals to be inserted into the female terminals are mounted. A lever 3 is provided with a cam groove 3*a* which effects a "lever action" is rotatably attached to the male connector housing 2. A cover 4 to be put on the female connector housing 1 is provided with engaging projections 4*a* at opposite center lower side walls.

In order to couple the connectors 1 and 2 to each other, as shown in FIG. 5B, the engaging projection 4*a* on the cover 4 is engaged with the cam groove 3*a* in the lever 3 and then the lever 3 is turned to a counterclockwise direction shown by an arrow. The cover 4 and female connector housing 1 are inserted into the male connector housing 2 by a cam action of the cam groove 3*a*. When the lever 3 is further turned to the counterclockwise direction from a position shown in FIG. 5C to a position shown in FIG. 5D, the terminals in the connector housings 1 and 2 are interconnected against a mechanical insertion resistance, thereby coupling the connectors.

The terminals mounted in the connector housings 1 and 2 are not always limited to a single kind or distribution of terminals. For example, FIG. 6A shows a hybrid type connector having the male connector housing 2 in which a few terminals 5 for an electrical power supply and many terminals 6 for a signal transmission are mounted. Since the many terminals 6 for a signal transmission are disposed at the right side in the drawing in the hybrid type connector, a mechanical insertion resistance upon insertion of the female connector housing 1 is imbalanced in the right and left areas so that the resistance in the right area is larger than that in the left area.

The female connector housing 1 is inserted into the male connector housing 2 while being inclined on account of such an imbalance of the insertion resistance. Consequently, the female connector housing 1 is finally coupled to the male connector housing 2 with the housing I being inclined relative to housing 2 as shown in FIG. 6C. This causes a problem since the signal terminals 6 are incompletely inserted into and contacting the mating terminals.

Even if such an imbalance of the insertion resistance is caused in a hand-insertion type connector, it may be relatively easily corrected by a worker since he or she can feel the imbalance of the insertion resistance. However, in the lever type connector wherein the female connector housing 1 is pushed down by the coupling mechanism which utilizes the "lever action" of the lever 3, the worker can not feel the imbalance. Consequently, the worker will mistake an incomplete coupling of the connector for a complete coupling even if the cause of the incomplete coupling is in the connector.

SUMMARY OF THE INVENTION

An object of the present invention is to provide a connector which can prevent both connector housings from being coupled to each other in an inclined position and prevent terminals from being incompletely coupled even if there is an imbalance in an insertion resistance.

In order to achieve the above object, a connector of the present invention wherein each of a pair of connector housings is provided with a plurality of terminals and said terminals are interconnected against their mechanical insertion resistance by forcing said connector housings to be displaced in a coupling direction by means of a coupling mechanism, is characterized in that resistance-applying means are provided on said connector housings at areas associated with those of a low insertion resistance of said terminals so as to give a resistance against a displacement of one housing relative to the other housing.

According to the connector of the present invention, an imbalance of an insertion resistance is corrected so as to insert terminals straight since an insertion resistance of terminals is increased in a lower resistance area upon coupling the connector.

According to the connector of the present invention, it is possible to prevent an incomplete contact of the terminals.

DETAILED DESCRIPTION OF THE PREFERRED EMBODIMENTS

Figure 1:
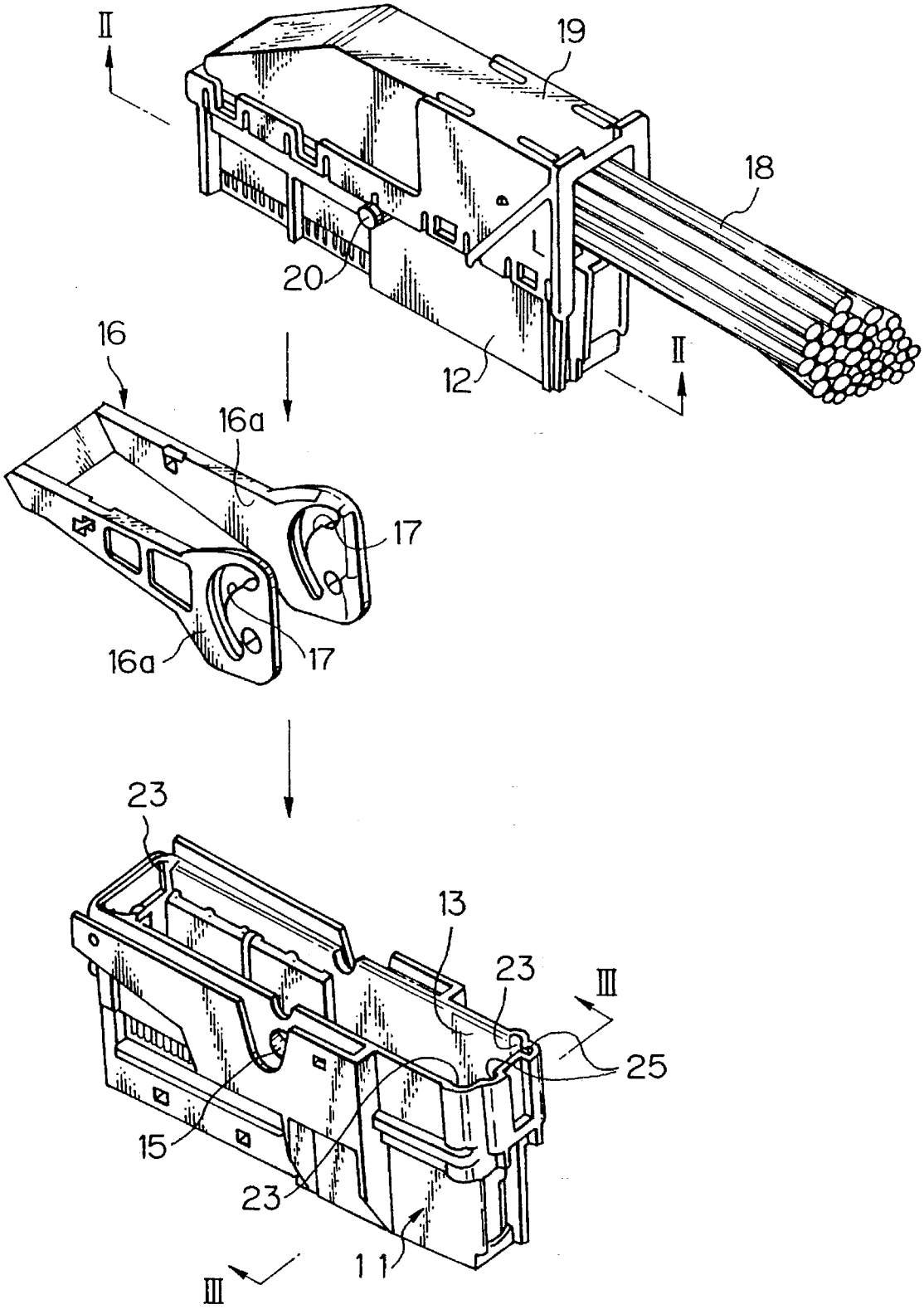
FIG. 1 is an exploded perspective view of an embodiment of a connector of the present invention.
Figure 4A:
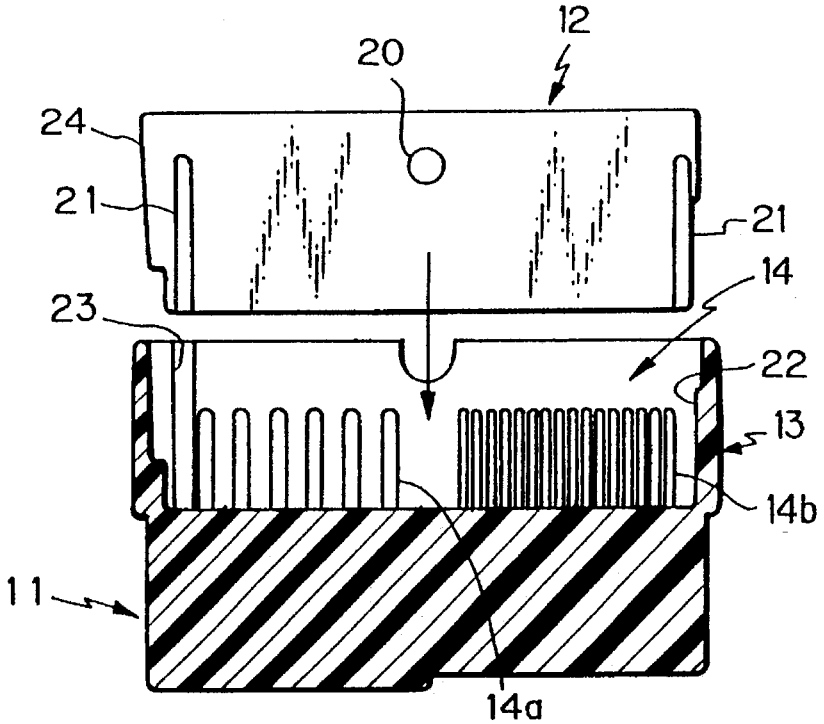
FIGS. 4A to 4C are longitudinal cross sectional views of an embodiment, illustrating processes of inserting the female connector housing.

An embodiment of a connector of the present invention will be described below by referring to FIGS. 1 to 4. A general construction of the connector is shown in FIG. 1. The connector comprises a male connector housing 11 and a female connector housing 12. The male connector housing 11 has a hood 13 which receives the connector housing 12 and has a number of male terminals 14 (see FIG. 4A). Relatively large terminals 14*a* for an electrical power supply and relatively small terminals for a signal transmission out of the male terminals 14 are arranged at a left half area and a right half area as shown in FIG. 4A.

The hood 13 of the male connector housing 11 is provided with lever bearing bosses 15 on opposite side walls thereof. An actuating lever 16 having two legs 16*a* is rotatably attached to the male connector housing 11 with the legs 16*a* being engaged with the bosses 15. Each leg 16*a* is provided with a cam groove 17 having a given arcuate shape around the lever bearing boss 15.

On the other hand, the female connector housing 12 has a size sufficient to be inserted into the hood 13 of the male connector housing 11. Female terminals not shown are adapted to be connected to the male terminals 14 including power terminals 14*a* and signal terminals 14*b* and are mounted in the female connector housing 12. A cover 19 is put on the housing 12 so as to cover electrical cables 18 which are connected to the female terminals and drawn out of an upper portion of the female connector housing 12.

A pair of cam follower bosses 20 are provided on center side walls of the cover 19 and the bosses 20 together with the actuating lever 16 constitute a coupling mechanism. That is, when the female connector housing 12 is inserted into the hood 13 of the male connector housing 11 with the cover 19 being attached to the housing 11, a distance between the legs 16*a* of the actuating lever 16 are widened by the cam follower bosses 20 and the bosses engage with the cam groove 17, respectively. When the lever 16 is turned with the bosses 20, engaging with the cam groove 17, the bosses 20 are pushed down by the cam groove 17 so that the female connector housing 12 is displaced in the hood 13 against a mechanical insertion resistance of the female and male terminals. Finally, the terminals are completely coupled.

Figure 2:
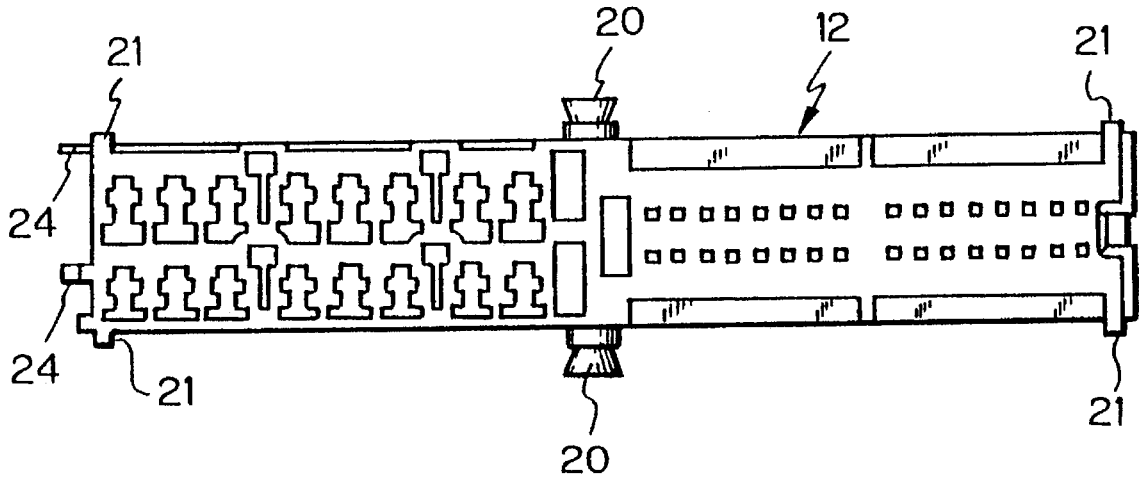
FIG. 2 is a bottom view of a female connector housing taken along lines II—II in FIG. 1.
Figure 3:
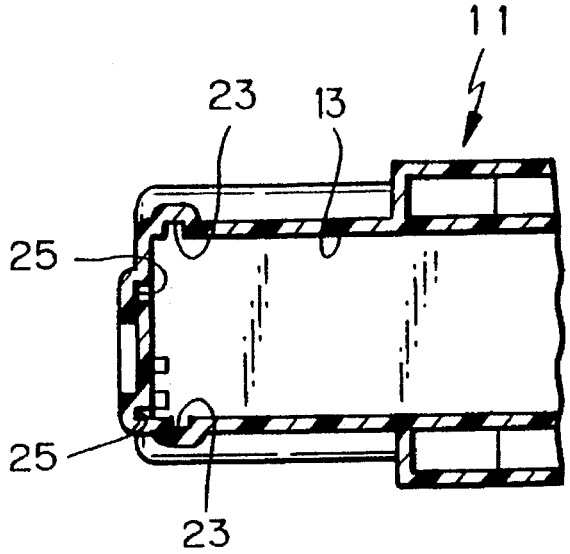
FIG. 3 is a fragmentary cross sectional view of a male connector housing taken along lines III—III in FIG. 1.

As shown in FIGS. 4 and 2, the female connector housing 12 is provided on opposite side ends with four guide ribs 21. Two guide ribs 21 on the right side end in FIG. 4A are moved while contacting with guide projections 22 provided on right end interiors of the hood 13 when the female connector housing 12 advances into the hood 13. The hood 13 is provided on the interior with guide grooves 23 which extend vertically (see FIGS. 3 and 1). When the female connector housing 12 is inserted into the hood 13, the two guide ribs 21 on the left side in FIG. 4A is inserted into and moved in the guide grooves 23.

The female connector housing 12 is provided on the left end wall in FIGS. 2 and 4A with two resistance-applying projections 24 which extend vertically and constitute a part of resistance-applying means. The hood 13 of the male connector housing 11 is provided on the interior with two slots 25 associated with the projections 24. The slots 25 extend in the interior of the housing 11 in an inserting direction of the female connector housing 12, so that a depth of the slots 25 does not alter in the insertion direction. However, an end face of the projection 24 (left end in FIG. 4A) is slanted downwardly in the inserting direction from a given position thereof so as to form a wedge shape.

In the above construction, a distribution density of the male terminals 14 is lower in a left half area in the hood 13 (all area of arranging the few power terminals 14*a*) than that in a right half area in the hood 13 (an area of arranging the many signal terminals 14*b*). Thus, when the female 12 is inserted into the hood 13 of the male connector housing 11 by actuating the lever 16, the mechanical insertion resistance associated with connection of the terminals becomes larger in the right half area than in the left half area. Heretofore, the female connector housing has been inserted into the male connector housing in a slanted position as noted above. Accordingly, there is a problem of contact failure in a part of the terminals.

In contrast, according to the present invention, since the female connector housing 12 is provided with the resistance-applying projections 24, the above problem can be solved as follows. When the female connector housing 12 is inserted from a position shown in FIG. 4A into the hood 13, each guide rib 21 on the female connector housing 12 is at first guided by the guide projection 22 and guide groove 23 in the hood 13 and the resistance-applying projection 24 on the female connector housing 12 begins to advance in the slot 25. At this stage, since the projection 24 on the female connector housing 12 is tapered, the projection 24 does not press-contact with the bottom of the slot 25 and is not subject to the mechanical insertion resistance.

Figure 4B:
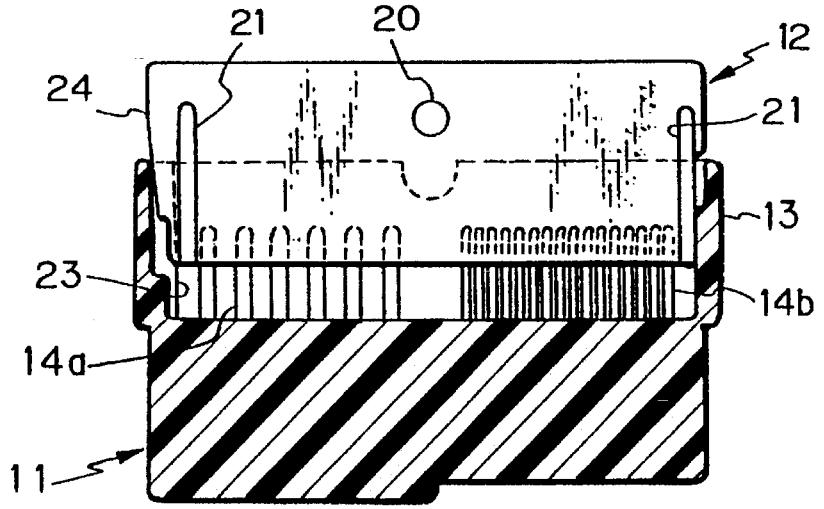

However, as shown in FIG. 4B, when the female connector housing 12 is inserted in the hood 13 to a position where the terminals begin to interconnect, the projection 24 press-contacts with the bottom of the slot 25 and the mechanical insertion resistance thus generated is applied to the female connector housing 12. Although the female connector housing 12 is pushed toward the right in the drawing due to such press-contact of the projection 24 with the slot 25, the female connector housing 12 is not displaced to the right since the housing is limited to move vertically by an engagement of the guide ribs 21 with the guide grooves 23.

Figure 4C:
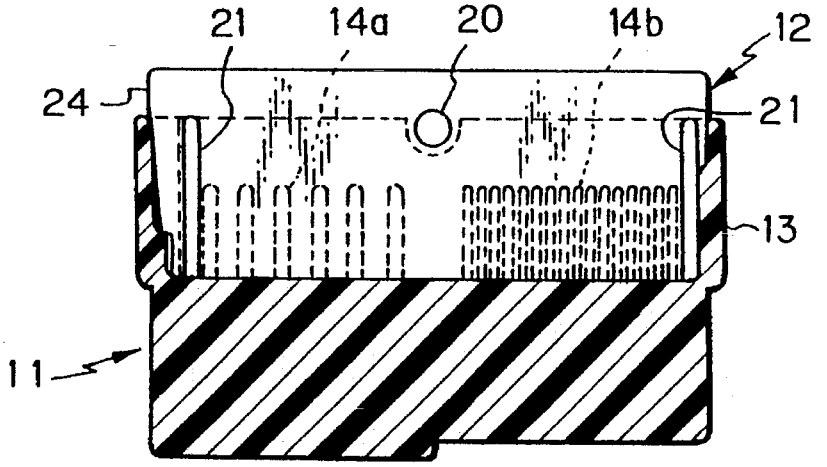
Figure 5A:
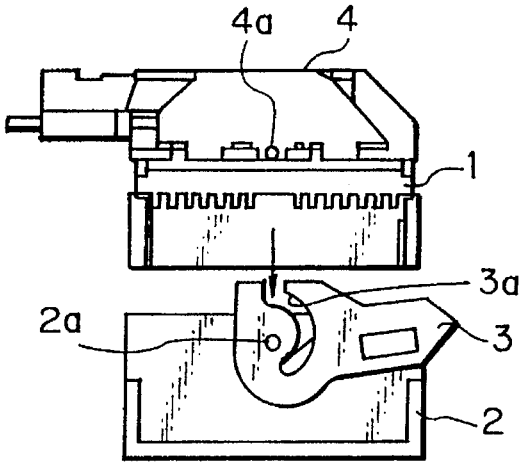
Fig. 5A PRIOR ART
FIGS. 5A to 5D are a schematic side elevational view illustrating a principle of a prior lever type connector.
Figure 5B:
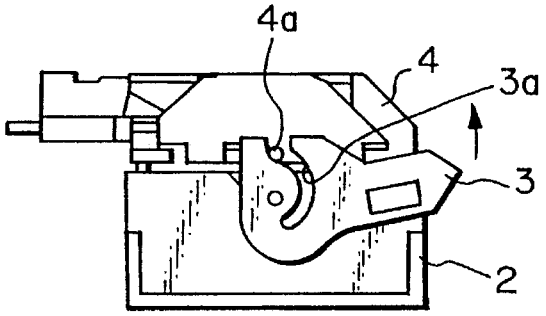
Fig. 5B PRIOR ART
Figure 5C:
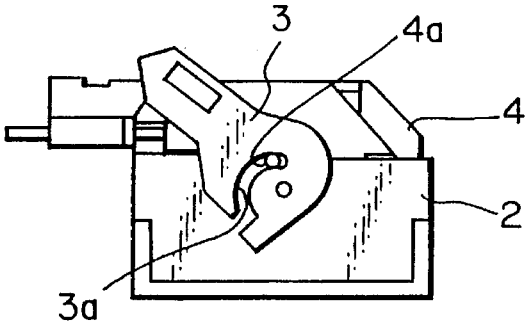
Fig. 5C PRIOR ART
Figure 5D:
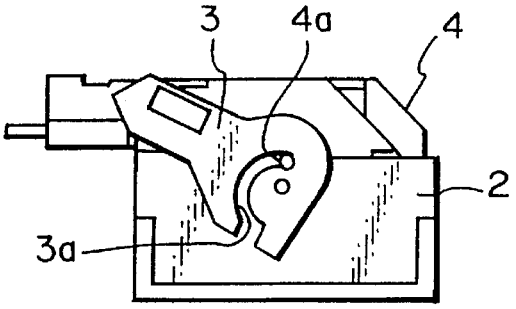
Fig. 5D PRIOR ART
Figure 6A:
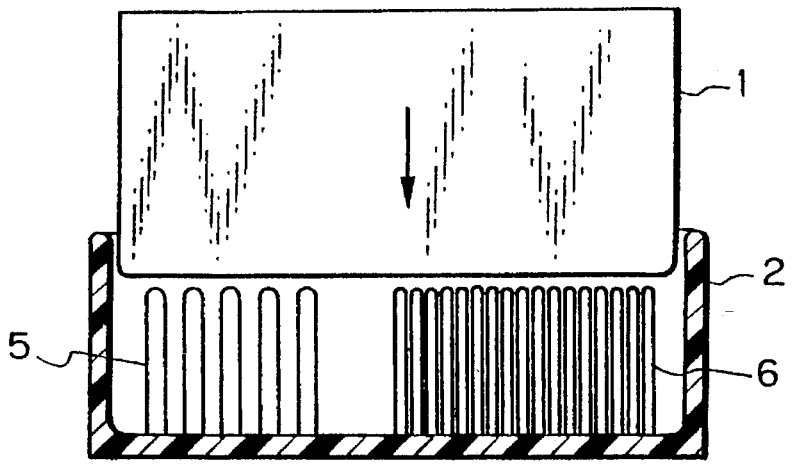
Fig. 6A PRIOR ART
FIGS. 6A to 6C are a schematic longitudinal cross sectional view illustrating a problem in the prior lever type connector.
Figure 6B:
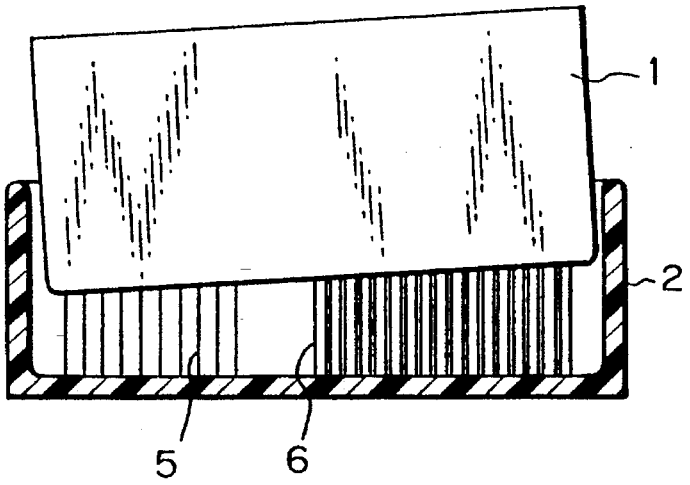
Fig. 6B PRIOR ART
Figure 6C:
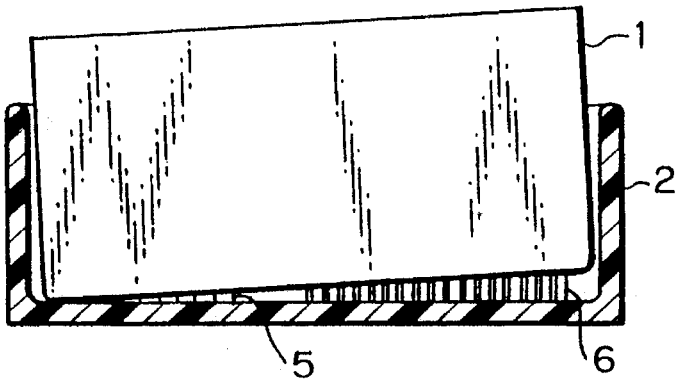
Fig. 6C PRIOR ART

The resistance-applying projection 24 is disposed at the left end of the hood 13 in opposition to the right end where the signal terminals 14*b* with a large mechanical insertion resistance is disposed. Thus, a distribution of insertion resistance upon inserting the female connector housing 12 is balanced at the right and left ends. Consequently, the female connector housing 12 advances in the hood 13 in the inserting direction without slanting. Finally, as shown in FIG. 4C, a lower end face of the female connector housing 12 completely contacts with the bottom of the hood 13. Accordingly, all terminals mounted in the connector housings 11 and 12 are interconnected at an even depth. It is possible to prevent contact failure due to incomplete insertion of the terminals.

The present invention should not be limited to the above embodiment. For example, the present invention can carry out the following alternatives:

(a) Although the above embodiment is applied to a lever type connector, the present invention may be generally applied to a connector in which female and male connector housings are forcibly interconnected by a coupling mechanism utilizing a bolt;

(b) Although the above embodiment is applied to a hybrid connector having large power terminals and small signal terminals, the present invention may be applied to a connector in which a distribution of insertion resistance is imbalanced due to an uneven density of arrangement of a single kind of terminal;

(c) Although the female connector housing 12 is provided with a wedge like resistance-applying projection 24 in the above embodiment, the hood 13 may be provided with a wedge like projection which contacts with the female connector housing 12 while the housing 12 may be provided with a portion which applies an insertion resistance to the housing 11. Also, the resistance-applying element against displacement of the housing is not limited to a wedge shape. It may be any means for applying a resistance against displacement of the housing, such as a friction means;

(d) Although the actuating lever 16 is attached to the male connector housing 11 and the cam follower boss 20 is provided on the cover 19 mounted on the female connector housing 12 in the above embodiment, the lever may be attached to one of the connector housings and the cam follower boss which directly engages with the lever may be provided on the other connector housing. Also a combination of the lever and cam follower boss may be reversed in the above embodiment. That is, the lever may be attached to the female connector housing while the cam follower boss may be provided on the male connector housing.

The present invention should not be limited to the above described and illustrated embodiment and may be altered within the scope of the spirit of the present invention.

What is claimed is:

1. A lever action connector comprising:

a pair of connector housings including a female connector housing having opposing end walls and opposing side walls with opposite side ends, and a male connector housing having a hood;

a plurality of terminals provided on each of said connector housings, said terminals having a variable distribution density such that a distribution density is lower in one half area of each of said connector housings than the distribution density in the other half area of each of said connector housings;

a coupling mechanism comprising a lever having cam grooves for effecting a lever action, said lever being rotatably attached to said male connector housing, and bosses respectively positioned at lower, central portions of said opposite side walls of said female connector housing, said bosses being operative to respectively engage in said cam grooves, such that when said lever is rotated with said bosses engaged in said cam grooves, said bosses are pushed down by said cam grooves thereby displacing said female connector housing in a coupling direction in said hood of said male connector housing so that said terminals are interconnected against their mechanical insertion resistance, so as to create areas of varying levels of mechanical insertion resistance due to the variable distribution density of said terminals;

a resistance-applying means provided on said connector housings at said one half area associated with a low level of said mechanical insertion resistance of said terminals so as to give a resistance against a displacement of one housing relative to the other housing, said resistance-applying means comprising a pair of spaced apart, wedge-shaped projections which extend vertically on one of said end walls, which is associated with said one half area and which is on a side toward which said lever is rotated during coupling of said connector housings, of said female connector housing, and a pair of corresponding slots provided within said hood of said male connector housing; and four guide ribs, with two of said guide ribs disposed on each of said opposite side ends of said female connector housing, and four corresponding guide grooves disposed on said hood of said male connector housing, thereby assuring that said female connector housing is limited to move vertically by engagement of said guide ribs with said guide grooves.

2. A lever action connector comprising:

a pair of connector housings including a female connector housing having opposing end walls and opposing side walls with opposite side ends, and a male connector housing having a hood;

a plurality of terminals provided on each of said connector housings, said terminals having a variable distribution density such that a distribution density is lower in one half area of each of said connector housings than the distribution density in the other half area of each of said connector housings;

a coupling mechanism comprising a lever having cam grooves for effecting a lever action, said lever being rotatably attached to said male connector housing, and bosses respectively positioned at lower, central portions of said opposite side walls of said female connector housing, said bosses being operative to respectively engage in said cam grooves, such that when said lever is rotated with said bosses engaged in said cam grooves, said bosses are pushed down by said cam grooves thereby displacing said female connector housing in a coupling direction in said hood of said male connector housing so that said terminals are interconnected against their mechanical insertion resistance, so as to create areas of varying levels of mechanical insertion resistance due to the variable distribution density of said terminals;

a resistance-applying means provided on said connector housings at said one half area associated with a low level of said mechanical insertion resistance of said terminals so as to substantially even out said areas of varying levels of mechanical insertion resistance, said resistance-applying means comprising a pair of spaced apart, wedger-shaped projections which extend vertically on one of said end walls, which is associated with said one half area and which is on a side toward which said lever is rotated during coupling of said connector housings, of said female connector housing, and a pair of corresponding slots provided within said hood of said male connector housing; and four guide ribs, with two of said guide ribs disposed on each of said opposite side ends of said female connector housing, and four corresponding guide grooves disposed on said hood of said male connector housing, thereby assuring that said female connector housing is limited to move vertically by engagement of said guide ribs with said guide grooves.

* * * * *